US005623787A

United States Patent [19]

Ali

[11] Patent Number: 5,623,787

[45] Date of Patent: Apr. 29, 1997

[54] TILE ROOF VALLEY GUARD

[76] Inventor: Elsayed A. Ali, 903 Highview Dr., Palm Harbor, Fla. 34683-6616

[21] Appl. No.: 583,722

[22] Filed: Jan. 5, 1996

[51] Int. Cl.[6] ..... E04D 13/00

[52] U.S. Cl. ..... 52/13; 52/12; 210/474

[58] Field of Search ..... 52/12, 13, 14, 52/15; 210/162, 474, 477

[56] References Cited

U.S. PATENT DOCUMENTS

| | | | |
|---|---|---|---|
| 669,495 | 3/1901 | Babcock | 210/474 |
| 678,995 | 7/1901 | Carnes | 52/13 |
| 2,988,226 | 6/1961 | Cambell | 210/477 X |
| 3,079,000 | 2/1963 | Volsi | 210/477 |
| 3,507,396 | 4/1970 | Homa | 210/477 |
| 4,553,356 | 11/1985 | Pepper | 52/11 |
| 4,592,174 | 6/1986 | Hileman | 210/474 X |
| 4,750,300 | 6/1988 | Winger, Jr. | 52/12 |
| 4,905,427 | 3/1990 | McPhalen | 210/474 X |
| 4,949,514 | 8/1990 | Weller | 210/474 X |
| 5,072,551 | 12/1991 | Manoogian, Jr. . | |
| 5,095,666 | 3/1992 | Williams, Jr. . | |
| 5,103,601 | 4/1992 | Hunt | 210/474 X |
| 5,109,640 | 5/1992 | Creson . | |
| 5,181,350 | 1/1993 | Meckstroth . | |
| 5,242,591 | 9/1993 | Beechert et al. | 210/477 X |

FOREIGN PATENT DOCUMENTS

| | | | |
|---|---|---|---|
| 36850 | 11/1926 | Denmark | 52/13 |
| 591711 | 4/1994 | European Pat. Off. | 52/11 |
| 1509127 | 8/1969 | Germany | 52/12 |
| 3505498 | 8/1986 | Germany | 52/11 |
| 3838919 | 5/1989 | Germany | 52/11 |
| 122354 | 5/1991 | Japan | 52/11 |
| 23080 | of 1892 | United Kingdom | 52/13 |

OTHER PUBLICATIONS

"Gutter Screen Said to Eliminate Drain Problems", American Roof Jul. 1949.

"Gutter Guard Prevents Back–Ups", American Roofer, p. 60 Feb. 1961.

*Primary Examiner*—Carl D. Friedman
*Assistant Examiner*—Laura A. Saladino
*Attorney, Agent, or Firm*—Harold D. Shall

[57] ABSTRACT

A resilient mesh elongated guard for the valley between adjoining angled sections of a tile roof wherein the guard is bent into a convex shape and positioned into the valley with the lateral edges of the guard engaging the sides of the opposed faces of the tile.

4 Claims, 1 Drawing Sheet

TILE ROOF VALLEY GUARD

BACKGROUND OF THE INVENTION

1. Field of the Invention

This invention relates generally to devices to prevent water from collecting in the valley of a slanted roof and more particularly to a tile roof valley guard which will inhibit the collection of debris in the roof valley.

The way a tile roof is constructed, the valley which interconnects adjoining angled roof sections of a slanted roof does not have a layer of tile over the tar paper sub roof. According to Bob Hightower Senior, "who has spent 41 years in the roofing industry and is chairman of the Pinellas County Construction Licensing Board's roofing committee" in Pinellas County, Fla., "leaks occur because the sub roof dries out and cracks with age—leaks are most likely to occur in valleys where standing water accelerates rotting" (quoted from the St. Petersburg, Times, Nov. 9, 1995 issue at page 2D). Standing water occurs in the roof valleys when debris accumulates in the valley and forms a dam behind which standing rain water accumulates and once there is a slight opening in the sub roof of the valley, a leak occurs.

Repair of the roof and replacement of the valley must be done to remedy the situation. However, prevention of the dam forming debris from accumulating will inhibit collection of standing water.

To prevent such an accumulation, an obvious solution is to repeatedly clean the valley to remove debris and thereby prevent formation of a dam. This is the prior art method of cleaning valleys. An unobvious yet more practical solution is to provide a device which prevents debris from entering the valley so that it cannot accumulate and form a dam.

SUMMARY OF THE INVENTION

It is, therefore, an object of this invention to provide a guard to prevent debris from entering a roof valley of a tile roof so that it cannot accumulate and form a dam.

It is another object of this invention to provide such a guard which is easily installed on existing as well as new roofs.

It is a further object of this invention to provide such a guard which, while preventing debris from entering the roof valley, will allow rain water to flow therepast into the valley and down the valley and off the roof.

To accomplish the above objects, this invention contemplates a guard made of a flexible resilient plastic which is screen-like in its configuration and when secured against the roof titles adjoining the valley in a convex cross section configuration, will prevent debris from entering the valley and forming a dam but will allow rain water (or for that matter water from other sources) to pass therethrough and into the valley and down the valley and off of the roof. Another advantage is that such a guard is easily removed and replaced.

DETAILED DESCRIPTION OF THE PREFERRED EMBODIMENT

Figure 1:
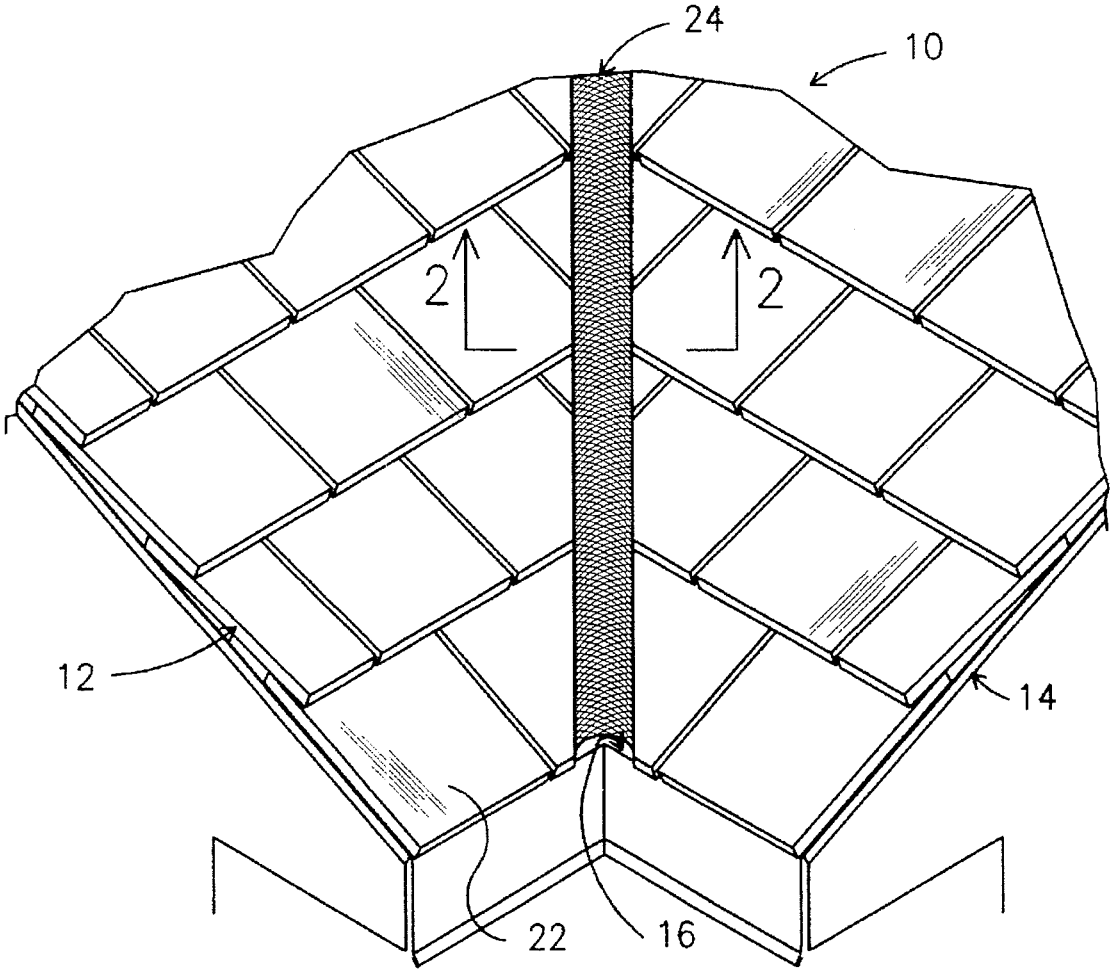
FIG. 1 is a perspective view of a portion of a tile roof with a roof valley guard according to this invention situated in the roof valley.

Referring now to the drawings, a hip portion of tile roof is shown generally at 10 and includes a left section 12 and a right section 14 disposed at an angle to each other and joined by a valley 16. The sections 12 and 14 have a layer of roof sheeting 18 conventionally made of plywood supported by the roof rafters (not shown). On top of the sheeting 18 is sub roof 20 made of strips of tar paper with the adjoining edges of the strips conventionally sealed with a layer of tar. The sub roof 20 extends over the valley 16 connecting the adjoining roof sections 12 and 14. The roof sections 12 and 14 have an exposed upper surface of tile 22 thereon, with the tiles in conventional over lapping relationship; however, as conventional construction practice dictates, the valley itself is not covered with tile.

Figure 2:
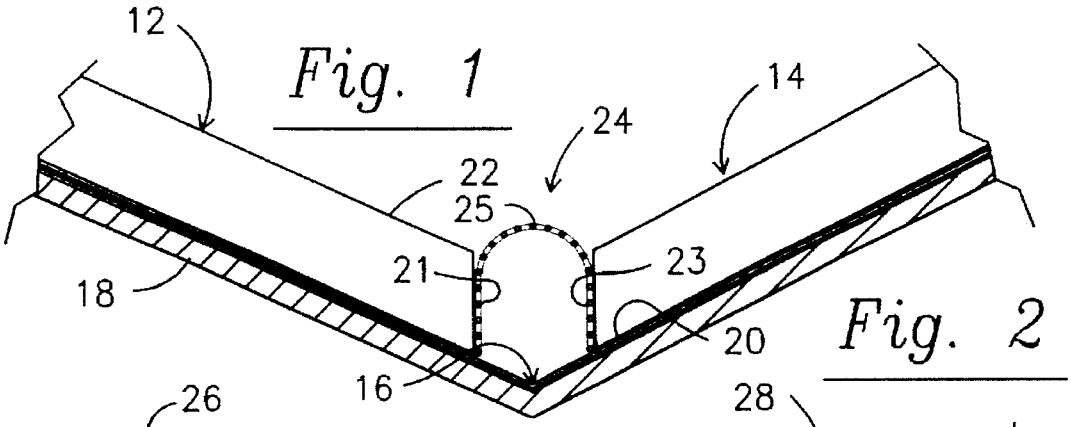
FIG. 2 is a sectional view taken along the lines 2—2 in FIG. 1.
Figure 3:
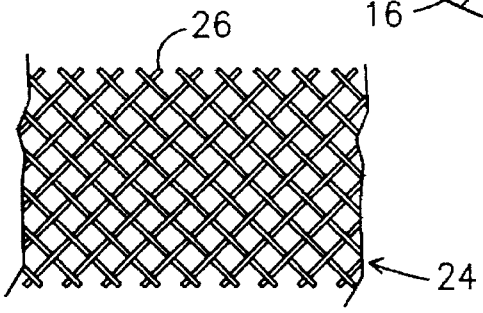
FIG. 3 is a plan view of a piece of the material usable in this invention.
Figure 4:
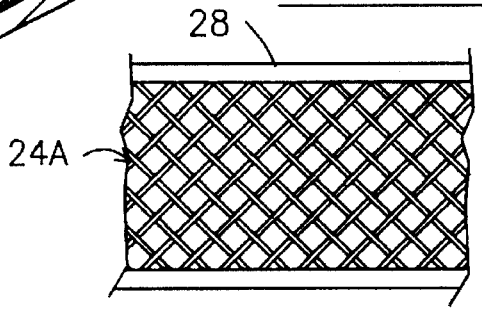
FIG. 4 is another embodiment of a piece of material usable in this invention.

As seen in FIG. 2, the tile on sections 12 and 14 terminate at the edge of the valley 16 and are in an opposed relationship. The edges of the tile which face each other are cut so as to be parallel to each other. The approximate width of the space between the tiles is approximately two inches, and the approximate thickness of the tile is approximately two inches. A guard 24 made of an elongated strip of resilient material approximately six inches wide having a great plurality of openings therein such as a mesh material with an open edge as seen at 26 in FIG. 3 or guard 24A with a closed edge as seen at 28 in FIG. 4, is bent in a convex arcuate configuration and inserted over the valley 16 with its lateral edges engaged with the inner sides of the opposed tiles of the roof sections 12 and 14, so that the guard 24 has an inverted "U" shape configuration with side legs 21 and 23 being substantially parallel and abutting the adjoining tiles of roof section 12 and 14 and the upper arcuate portion 25 of the guard 24 being substantially level with the top of the adjoining tiles.

The guard 24 is made from a material having a great plurality of openings therein and having inherent resilient qualities such as resilient co-polymer plastic strips sold as "Gutter Guard" by the Home Products Division of ALUMAX and available from Home Depot in Pinellas County, Fla. Because of the inherent resilient qualities of the strip 24, it need not be secured in the valley 16, as merely flexing the strip and inserting same between the tiles 22 of the adjoining sections 12 and 14, at the base of the tiles, will retain the guard 24 in a secure relationship with the sections 12 and 14 over the valley 16. With the guard 24 in place over the valley 16, debris is prevented from entering and accumulating in the valley 16, while water may so enter and run down the valley and off the roof.

Although the above description relates to presently preferred embodiments, numerous changes can be made therein without departing from the scope of this invention as claimed in the following claims.

What is claimed is:

1. A tile roof valley guard comprising in combination a) a slanted roof having adjoining sections interconnected at an angle thereby forming a valley therebetween, b) said roof including a layer of sheeting, a layer of subroofing material on top of said sheeting and extending over said valley, and a layer of tiles on top of said layer of sub roofing material on the adjoining roof sections and terminating at the edge of the valley whereby said tiles of one roof section are spaced from and opposed to said tiles of the other roof section, and said opposed faces of said opposed tiles of said adjoining roof sections are formed parallel to each other, and c) an elongated strip of resilient material having a great plurality of openings therein bent into a convex shape when viewed in transverse cross section with the lateral edges of said strip resiliently engaging the entire opposed edges of said tiles adjacent to the sides of said valley with said engagement being substantially from the bottom to the top of said tiles.

2. A valley guard according to claim 1 wherein said resilient material is of mesh configuration.

3. A valley guard according to claim 2 wherein said resilient material is a co-polymer plastic.

4. A valley guard according to claim 3 wherein the convex shape of said resilient material, when viewed in cross section, is an inverted "U" with the legs of the "U" substantially parallel.

* * * * *